United States Patent [19]

Riihinen

[11] Patent Number: 4,614,565

[45] Date of Patent: Sep. 30, 1986

[54] METHOD FOR EDDY CURRENT HEATING A ROLL IN A PAPER MACHINE

[75] Inventor: Jaakko Riihinen, Jyväskylä , Finland

[73] Assignee: Valmet OY, Finland

[21] Appl. No.: 560,394

[22] Filed: Dec. 12, 1983

[30] Foreign Application Priority Data

Dec. 14, 1982 [FI] Finland ..... 824281

[51] Int. Cl.[4] ..... H05B 6/14

[52] U.S. Cl. ..... 162/206; 29/116 AD; 100/93 RP

[58] Field of Search ..... 100/93 RP, 917; 162/206; 29/132, 116 AD

[56] References Cited

U.S. PATENT DOCUMENTS 3,489,344 1/1970 Keyes ..... 236/1
4,384,514 5/1983 Larivé et al. ..... 100/917
4,485,540 12/1984 Riihinen ..... 29/116 AD

FOREIGN PATENT DOCUMENTS 0812697 8/1981 Finland .
2083729 3/1982 United Kingdom .

*Primary Examiner*—Steve Alvo
*Attorney, Agent, or Firm*—Steinberg & Raskin

[57] ABSTRACT

A method and apparatus for the inductive heating of a roll used in the manufacture of paper by means of eddy currents, such as the inductive heating of a calender roll. In the apparatus, pole shoe devices provided with electromagnetic coils are used, by means of which the eddy-current heating is applied only to the surface layer of the roll, the surface layer being constituted of ferromagnetic material, solely from outside the roll. The apparatus comprises several iron cores placed side by side and provided with magnetizing coils. Into each coil, a magnetizing current is passed, the magnetizing current being of adjustable intensity and/or frequency to control the temperature profile of the roll in the axial direction thereof.

7 Claims, 5 Drawing Figures

METHOD FOR EDDY CURRENT HEATING A ROLL IN A PAPER MACHINE

BACKGROUND OF THE INVENTION

The invention relates to an apparatus and a method for heating a roll used in the manufacture of paper, such as a calender roll, inductively by means of eddy currents, in which apparatus pole shoe devices provided with electromagnetic coils are used.

The invention additionally relates to a roll heated electromagnetically by means of eddy currents, such as a calender roll so heated, as well as to the use of such a roll.

It is known in the prior art to heat calender rolls and drying cylinders in the drying section of a paper machine, by means of pressurized fluid or steam. Since temperatures higher than 100° C. are desired in the heating, sealing problems are encountered in the use of steam. Moreover, conventional heated rolls are expensive to manufacture, because they must be manufactured as pressure vessels. The efficiency of heating rolls by means of a pressure medium is also poor, partially because large masses must be heated therein. Moreover, the adjustment of the temperature profile in the axial direction of the rolls causes difficulties.

In view of achieving certain particular objects, FI patent application No. 812697 discloses an electromagnetically heatable roll, in particular a calender roll, which is provided with a mantle of a ferromagnetic material and with a magnet inductively generating eddy currents in the same. In the arrangement disclosed in this patent application, several magnets have been fitted in blocks placed side by side in the axial direction, leaving at least the working zone within the outer circumference free. The set value corresponding to the change in the magnetic flux in the mantle of the roll can be adjusted separately within each block or groups of blocks. At least one temperature measurement-value detector is used, which indicates the measurement value corresponding to the actual value of the temperature of the outer surface of the roll mantle at different locations axially spaced from each other. A system of control circuits has been formed which changes the set values on the basis of the measurement values and of the temperature profile given in advance for the outer surface of the roll mantle.

However, it is a drawback of the heating arrangement of FI patent application No. 812697 that it is necessary therein to heat a roll having a relatively thick mantle. Also, the interior of the supporting roll mantle is also occupied by the electric heaters or equivalent, so that it is impossible to provide the rolls with the variable-crown equipment, which is itself known and which has been observed to be advantageous in practice and indispensable, e.g., in connection with calender rolls. In the above Finnish patent application, the most important aspect has been considered to be a closed control system, in which the temperature of the roll is detected at different points in the axial direction of the roll and, on the basis of these measurements, the adjustment of the temperature profile is carried out. However, since it is necessary in this regard, to use a roll having a relatively thick wall and to heat relatively large masses, a detrimental delay is caused in the control system.

SUMMARY OF THE INVENTION

Thus, it is an object of the present invention to avoid the drawbacks stated above, and to provide a new kind of eddy-current heating apparatus, and a roll used in connection with the same.

It is a further object of the present invention to provide a new kind of machine stack or super-calender, in which the heating effect and the adjustment of the heating profile can be utilized more favorably than in the prior art.

A further object of the invention is to provide a device with easy, simple maintenance, such device being, moreover, easily applied to existing calenders without having to perform essential alterations in either the construction of the calenders or in the construction of the device itself.

The objects stated above and other objects to become apparent below, are achieved in that by means of the apparatus, eddy-current heating is applied only to the surface layer of the roll (such as a calender roll), the surface layer being constituted of a ferromagnetic material, exclusively from outside the roll.

The roll in accordance with the present invention, such as a calender roll, heated electromagnetically by means of eddy currents, is principally characterized by the roll comprising an interior support frame, a heat insulation layer disposed on the frame and formed of a magnetically non-conductive material, and an outer mantle of a ferromagnetic material fitted onto the heat insulation layer, the inductive eddy-current heating being directed and substantially confined to the outer mantle, from outside the roll.

The heating apparatus described above is advantageously used in accordance with one or several rolls in a calender stack, preferably in accordance with an upper and/or lower roll in such a calender stack.

BRIEF DESCRIPTION OF THE DRAWINGS

The invention will be described in detail below, with reference to the exemplary embodiments of the invention illustrated in the various figures of the drawings, with the scope of the invention not being restricted to the details of the exemplary embodiments.

In the drawings.

DETAILED DESCRIPTION OF THE PREFERRED EMBODIMENTS

Figure 1:
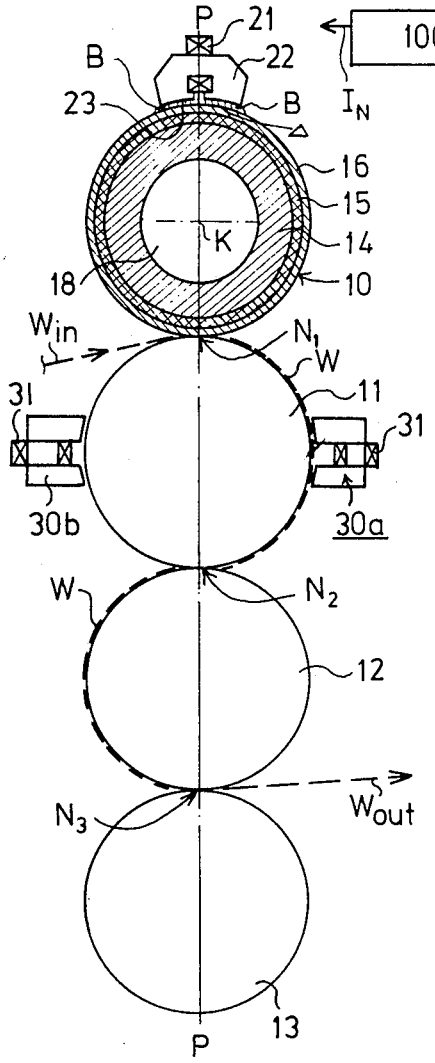
FIG. 1 is a side elevational view, partially in section, of a calender provided with a heating apparatus in accordance with the present invention.

FIG. 1 is a schematic illustration of a machine stack, also known as an "on-machine" calender. The calender comprises a calender stack constituted by calender rolls 10, 11, 12 and 13. These rolls 10–13, which are hard-faced calender rolls, are journaled to a known frame and are provided with drive gears in a known fashion. The construction of the frame and drive unit of the calender is well-known and, as such, is not illustrated in the drawings. The rolls 10, 11, 12 and 13 are arranged in pairs, to form hard calendering nips $N_1$, $N_2$, and $N_3$, through which the web W to be calendered, coming from the paper machine, passes through the nips along the path illustrated in FIG. 1. The entrance of the web W into the calender is denoted by $W_{in}$, and outlet correspondingly by $W_{out}$. The rolls 10–13 may be constructed as variable-crown rolls in a known manner, from conventional calender rolls. In the hard nips $N_1$, $N_2$, and $N_3$, both smoothing of the face of the web W and equalizing of the thickness of the web W (calibration) take place. The nips $N_1$, $N_2$, $N_3$, and the center axes K—K of the rolls 10–13, are situated in substantially the same vertical plane P—P.

Figure 2:
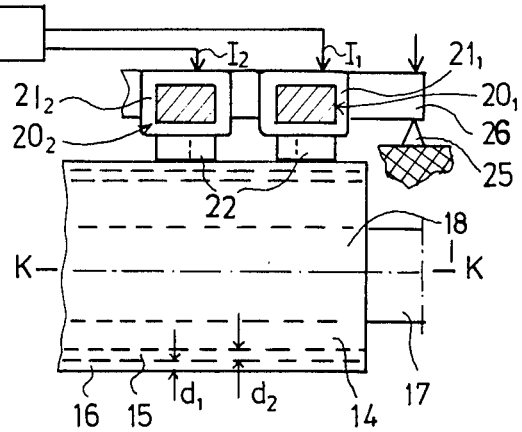
FIG. 2 is a front elevational view, partially in section, of a heating system of the present invention, illustrating arrangement of magnetizing devices in the direction of the axis of rotation of a calender roll.

With a view toward improving the surface properties of the paper web W to be calendered, as illustrated in FIG. 1, the uppermost roll 10 in the calender stack is, in accordance with the present invention, arranged as a roll which can be inductively heated by means of eddy currents, the surface temperature of roll 10 being, by means of such heating, increased to a level considerably higher than the temperature of the web W, e.g., higher than 100° C. For inductive heating, as illustrated in FIGS. 1 and 2, a beam 26 is provided in the plane P—P above the roll 10, several pole shoe devices $20_1$, $20_2$, . . . $20_n$ being attached to the beam 26. Beam 26 is supported at both ends on support members 25, which are illustrated schematically.

Pole faces 23 of the iron cores 22, facing towards the outer surface of the roll 10, are at a distance of a small air gap Δ from the outer surface of the roll 10 to be heated. Support members 25 are provided for supporting the beam 26 and pole shoe devices noted therein. The support members 25 preferably comprise hydraulic cylinders or pneumatic bellows, by means of which it is possible to shift the entire eddy-current heating device out of its position and, if required, to adjust the air gap Δ between the pole face 23 and the roll surface to appropriate size. Each of these devices 20 comprise a plate stack iron core 22 made of a magnetically soft material, the plates in each stack being isolated from each other in a known manner to prevent losses of eddy currents. In connection with the iron cores 22, magnetizing coils $21_1$, $21_2$, . . . $21_N$, are provided, with a controlled current $I_1$, $I_2$, . . . $I_N$ being passed to each of the individual magnetizing coils from the electricity source 100. The eddy-current heating device extends over substantially the entire length of the roll 10.

Figure 3:
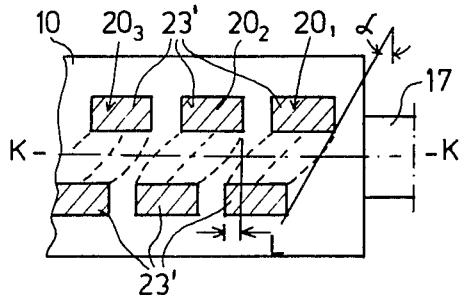
FIG. 3 is a plan view in section at pole faces of the magnetizing devices, and illustrating the position of the pole faces with respect to the roll being heated, in the system of FIG. 2.

According to the invention, a specific insulated roll 10 is used in connection with the eddy-current heating device. As illustrated in FIGS. 1, 2 and 3, this roll 10 comprises a tubular inner frame 14, which is, for example, formed of cast iron and in whose interior 18, it is possible to provide conventional variable-crown equipment based on hydraulic zones and/or on mechanical friction shoes which are known, per se. On the frame 14, an annular heat-insulation layer 15 is provided, which is formed of a magnetically nonconductive material, e.g. Teflon (PFTE) or of concrete, to withstand the elevated temperatures produced by the apparatus of the invention. On the layer 15, there is an outer mantle 16 formed of a magnetically conductive ferromagnetic material, such as iron or steel, the wall thickness $d_1$ (FIG. 2) of the mantle 16 being as small as possible in view of the mechanical loading. The outer mantle 16 is heated by means of high-frequency eddy currents generated by the magnetic flux, designated B, the currents being produced by means of the coils 21. The magnetizing electric currents $I_1$, $I_2$, . . . $I_N$ for the coils 21 are either DC current or AC current (preferably three-phase) or combinations of these. The frequency of the eddy currents in the roll mantle 16 is determined partially by the rate of rotation of the roll 10, and partially by the frequency of the magnetizing AC currents. The magnetizing frequency f is arranged, and if necessary adjusted, to such a level that the depth of penetration of the magnetic flux B in the mantle 16 is substantially equal to the thickness $d_1$ of the outer mantle 16. The thickness $d_1$ of the outer mantle is preferably within the range of about 1–50 mm, whereas the diameter of the roll 10 is preferably in the range of about 400–1000 mm. Correspondingly, the thickness $d_2$ of an insulation layer 15, e.g. of Teflon, is preferably in the range of about 10–100 mm. The intermediate mantle 15 prevents any significant transfer of the heat generated by the magnetic flux B and by the eddy currents, from the outer mantle to the roll frame 14.

FIGS. 2, 3, 4 and 5 illustrate some alternative embodiments for the situation of the magnetic shoe devices in the eddy-current heating apparatus of the present invention. In accordance with FIGS. 1, 2, and 3, each iron core 22 has two pole faces 23, by means of which the lines of magnetic flux are caused to pass through the mantle 16 of the roll 10, to form a closed flux circuit in the manner illustrated in FIG. 3. The pole faces 23′ are arranged in pairs, the faces of a pair being situated at an angle α with respect to one another and overlapping each other in relation to the center axis K—K of the roll 10., and also relative to the perpendicular vertical plane P—P. By means of this overlapping position of the pole faces 23′, the heating effect of the eddy currents is distributed uniformly over substantially the entire length of the roll.

Figure 4:
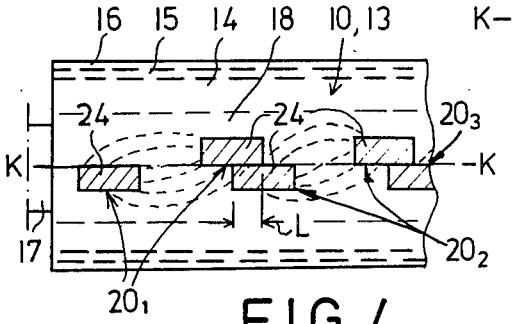
FIG. 4 is a plan view, in section, similar to FIG. 3, illustrating an alternative arrangement of the pole faces with respect to the roll being heated.
Figure 5:
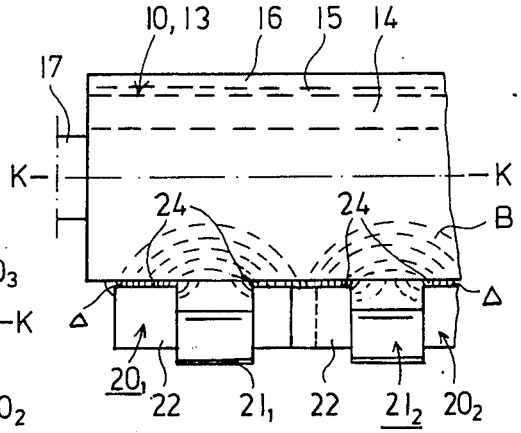
FIG. 5 is a front elevational view of a heating system according to the alternative embodiment of the present invention illustrated in FIG. 4.

FIGS. 4 and 5 illustrate an alternative embodiment of the overlapping of the pole faces in connection with the outer rolls 10 or 13. The pole faces 24 are placed symmetrically at both sides of the center plane K—K, and with a certain axial overlapping L.

In the embodiments illustrated in all the FIGS. 1–5, the iron cores 22 are situated symmetrically relative to the vertical plane P—P of the calender, making it possible to compensate any power effects caused by the magnetic flux B in the air gap Δ.

As illustrated in FIG. 1, the eddy-current heating device is placed above the uppermost roll 10 of the stack of calender rolls, symmetrically relative to the vertical center plane P—P. The heating effect is applied to the web W in the first nip $N_1$, and the subsequent nips $N_2$ and $N_3$ can be used for the calibration of the thickness of the paper web W.

According to FIG. 1, magnetizing devices 30*a* and 30*b*, provided with coils 31, are additionally fitted in connection with the roll 11 one opposite the other in the same horizontal plane, their power effects compensating each other. The roll 11 may be identical to roll 10, or alternatively, a conventional calender roll. The eddy-current heating devices 30*a*, 31 apply the heating effect through the web W. The devices 30*a* and 30*b* are frequently not required. To the contrary, it may be advantageous to place a device corresponding to the eddy-current heating device above the roll 10 and/or underneath the roll 13 symmetrical to the plane P—P, in which case the web W is also heated in the last nip $N_3$ of the calender. In such a situation, the roll 13 is similar to the roll 10 described above, i.e., provided with heat insulation in the form of a magnetically nonconductive heat insulation layer 15 (FIG. 5).

In accordance with the invention, it is possible to adjust the temperature profile over the roll, by adjusting the intensities and/or the frequencies of the magnetizing currents $I_1, I_2, \ldots I_N$. The power source 100 may be provided with regulating transformers, regulating converters and/or frequency converters, which are known.

By means of the invention, a number of advantages are obtained in practice. When a magnetically non-conductive insulation layer 15 of low heat conductivity is used in accordance with the invention, underneath a relatively thin magnetically conductive surface layer 16 in a roll 10 or 13 heated by means of eddy currents, an especially high efficiency of heating is obtained, because heat is applied only to the surface layer of the roll, and not to the other components of the roll. Since the zone of the calendering nips is short, and, consequently, the time delay within the nips short, heating of the web W is controlled by the surface temperature of the roll 10.

It is an important advantage of the invention that, when an external heating device is used, interior 18 of the roll 10 can be made available for the variable-crown equipment. Another important advantage of the invention is the possibility of adjusting the temperature profile. It is also possible, even though not frequently necessary, to arrange measurement of the surface temperature of the roll 10 at several different points in the radial direction of the roll, and to combine these measurement devices in a closed control system, by means of which either a uniform or a certain preset temperature profile is accomplished in the axial direction of the calendering roll 10.

The roll in accordance with the invention, provided with an insulation layer 15, can be manufactured by means of several techniques. One possibility is to prepare the interior of the frame 14 separately, then to provide it with an insulation layer 15, and then, to push onto the insulation layer, a prefabricated cylindrical outer mantle 16 having been previously heated considerably in excess of the operating temperature of the outer layer 16 (after eddy-current heating). When the cylinder 16 cools, a reliable compression joint is obtained between the parts 14, 15 and 16.

When the roll 10 or 13 is used as the uppermost or lowermost roll in a calender stack in accordance with the invention, the outer mantle 16 can even be permitted to expand, due to the rise in temperature, even to the extent that the outer mantle 16 loosens from the intermediate mantle 15.

The preceding description of the present invention is merely exemplary, and is not intended to limit the scope of the present invention in any way thereof.

What is claimed is:

1. A method for heating a roll in the production of paper, which comprises applying eddy current heating to only an outer surface layer of the roll, and exclusively applying the eddy current heating from outside the roll, to inductively heat the roll, comprising the steps of:

providing the roll with an outer surface formed of ferromagnetic material, disposing the outer layer of the roll about a heat insulation layer of magnetically non-conductive material, to confine the eddy current heating to substantially within the outer layer from exclusively outside the roll, disposing means for applying the eddy current heating outside the roll proximate to the outer surface layer thereof, conducting magnetizing current through the means to generate magnetic flux from the means to pass only through the outer surface layer, and adjusting at least one of intensity and frequency of the magnetizing current, to control temperature profile along an axial direction of the roll.

2. The method of claim 1 which comprises providing the means in the form of a plurality of discrete pole faces across from the outer layer of the roll, to define the discrete gap and disposing adjacent pole faces to overlap one another in an axial direction of the roll, to distribute uniformly the eddy current field over substantially the entire length of the roll.

3. The method of claim 2 comprising the steps of disposing a plurality of rolls in a calendering stack, and inductively heating at least one of the top and bottom rolls of the stack,

4. The method of claim 3 which comprises symmetrically heating the at least one roll with respect to a center plane passing through the stack, to minimize power effect caused by magnetic flux generating the eddy current heating.

5. The method of claim 4 which comprises the steps of applying the effect of the inductive heating of the at least one roll to a paper web passing through a nip formed between the at least one roll and an adjacent roll, and calibrating said paper web passing through a second nip formed between two adjacent rolls in the calendering stack.

6. The method of claim 5, which comprises the additonal steps of disposing at least three rolls in the calendering stack, including at least one intermediate roll, and applying the effect of inductive heating to the paper web as it passes around the at least one intermediate roll.

7. The method of claim 2, wherein the magnetizing current is conducted through a magnetizing coil disposed about each respective pole face.

* * * * *